United States Patent [19]

Herbert

[11] 4,015,524

[45] Apr. 5, 1977

[54] PROOFING PRESS

[75] Inventor: Lawrence Herbert, New York, N.Y.

[73] Assignee: Pantone, Inc., Moonachie, N.J.

[22] Filed: Sept. 17, 1975

[21] Appl. No.: 614,123

[52] U.S. Cl. ..... 101/247; 101/328; 101/352

[51] Int. Cl.[2] ..... B41F 13/24

[58] Field of Search ..... 101/212, 213, 216, 246, 101/247, 328, 348, 349, 352, 375, 141, 409, 269

[56] References Cited

UNITED STATES PATENTS

| | | | |
|---|---|---|---|
| 1,470,194 | 10/1923 | Robinson | 101/352 X |
| 1,922,533 | 8/1933 | Elliott | 101/352 |
| 2,026,434 | 12/1935 | Quick et al. | 101/247 |
| 2,682,218 | 6/1954 | Baumgartner | 101/247 |
| 2,716,942 | 9/1955 | Timson et al. | 101/216 X |
| 2,868,122 | 1/1959 | Faeber | 101/348 |
| 3,107,608 | 10/1963 | Ward | 101/352 |
| 3,370,533 | 2/1968 | Westra et al. | 101/409 X |
| 3,598,050 | 8/1971 | Thompson | 101/216 |

FOREIGN PATENTS OR APPLICATIONS

| | | | |
|---|---|---|---|
| 1,088,659 | 10/1967 | United Kingdom | 101/352 |

*Primary Examiner*—E.H. Eickholt
*Attorney, Agent, or Firm*—Bauer, Amer & King

[57] ABSTRACT

Preparatory to a printing run, a printed sample, i.e. proof, is produced on a proofing press using the ink and paper substrate contemplated for the printing run so that the printing quality, ink color, and other such aspects can be studied and, if need be, any adjustments made. In the within improved proofing press, the ink film to be tested is transferred from a driven roller to a similarly driven roller carrying the test paper substrate by a pivotally traversable ink-transfer surface of an elastomeric construction material, such that said driven rollers are each powered in rotation at a selected speed simulating the printing speed of the contemplated printing run, and the extent to which the elastomeric transfer surface is allowed to be compressed permits effective simulation of the contemplated printing run printing pressure. Accordingly, the proof sample of the within proofing press contributes to a more accurate forecast of the printing quality, etc. of the contemplated printing run.

8 Claims, 9 Drawing Figures

100
68
110
144
104
154
116
114
102
142
72

100
68
102
144
110
154
116
114
142
72

100
68
144
110
116
154
114
142
102
106
72

102
130
132
134
136
128
126
124
100
154
158
144
156
140
122
142
120
116
148
114
146
118
112
110
168
170

PROOFING PRESS

The present invention relates generally to an improved proofing press, the improvements more particularly contributing to the production of proofing samples by the press which, in contrast to any such proofing samples heretofore, more accurately simulate the actual printing conditions of the contemplated printing run being supervised or monitored.

As generally understood, good practice dictates the visual and/or possible instrument testing of proof samples in advance of large printing runs to check the quality of printing, ink color, paper substrate performance, and other such aspects of the contemplated printing run. While proofing presses are already well known and available for this advance checking function, they are unable to simulate some significant conditions prevailing during the actual printing run, as for example the printing speed and printing pressure, and thus the proofing samples "pulled" on these presses are unavoidably incapable of demonstrating with total accuracy the printing that will result from the printing run. Undoubtedly, the speeds of operation and range of working pressures of known proofing presses are severely limited in order to avoid the complexity in structure and controls that are provided on commercial printing equipment to provide a broader range of these operating parameters.

Broadly, it is an object of the present invention to provide an improved proofing press overcoming the foregoing and other shortcomings of prior art proofing presses. Specifically, it is an object to provide a very simply constructed printing press, particularly advantageously used to produce proofing samples, which is readily operated at a selected speed and pressure during its printing operation, to thereby accurately simulate these operating parameters of commercial printing equipment.

A proofing press demonstrating objects and advantages of the present invention includes a variable speed drive operatively arranged to power in rotation at least one driving roller and having drive means connected from said driving roller to transmit the rotative movement thereof to a cooperating pair of front and rear driven rollers spaced from each other so as to define an ink film forming station therebetween in conjunction with plural idler ink film forming rollers operatively arranged to be driven in rotation by said front and rear driven rollers so as to spread an ink supply into a film on the surfaces of each idler roller and on said pair of driven rollers. In addition, the rotative power of said driving roller is transmitted to a substrate sample transport roller spaced from said front driven roller so as to define a sample inking station therebetween. Completing the within proofing press is an inking roller at said inking station mounted to be pivotally traversable between positions of established pressure contact initially with said front driven roller having said ink film over the surface thereof and subsequently with said substrate sample being urged through printing movement relative to said inking roller by said transport roller. Accordingly, the sample is printed at a speed and at a pressure selected to simulate these parameters of the contemplated printing run.

The above brief description, as well as further objects, features, and advantages of the present invention, will be more fully appreciated by reference to the following detailed description of a presently preferred, but nonetheless illustrative embodiment in accordance with the present invention, when taken in conjuction with the accompanying drawings, wherein.

Figure 2:
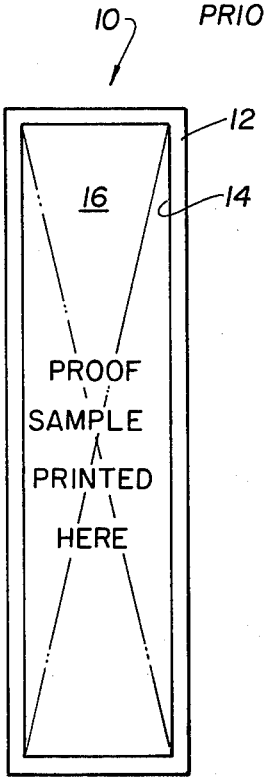
FIG. 2 is an illustation of a typical proof sample.
Figure 4:
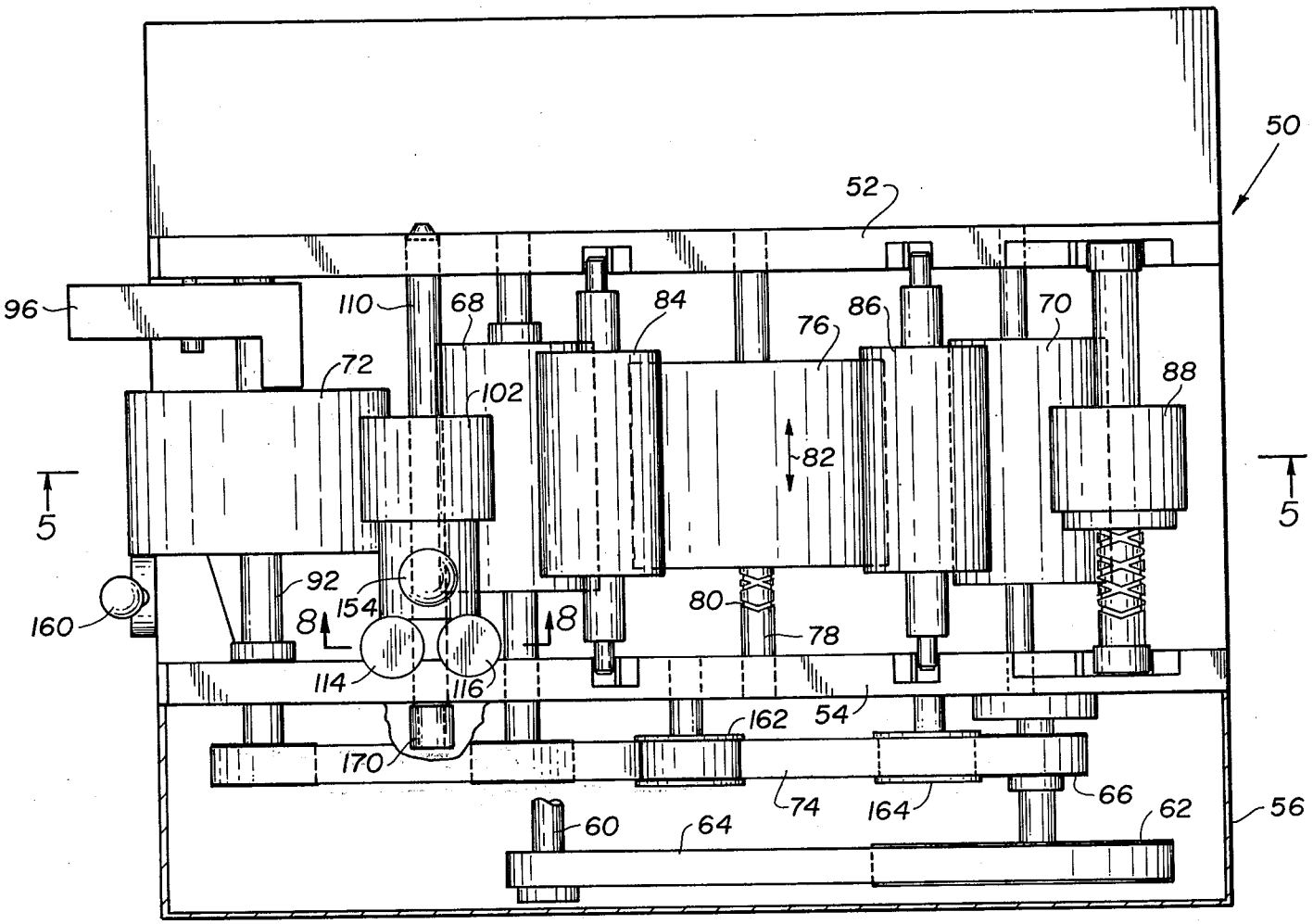
FIG. 4 is a plan view of the proofing press as projected from FIG. 3 showing further structural details.
Figure 5:
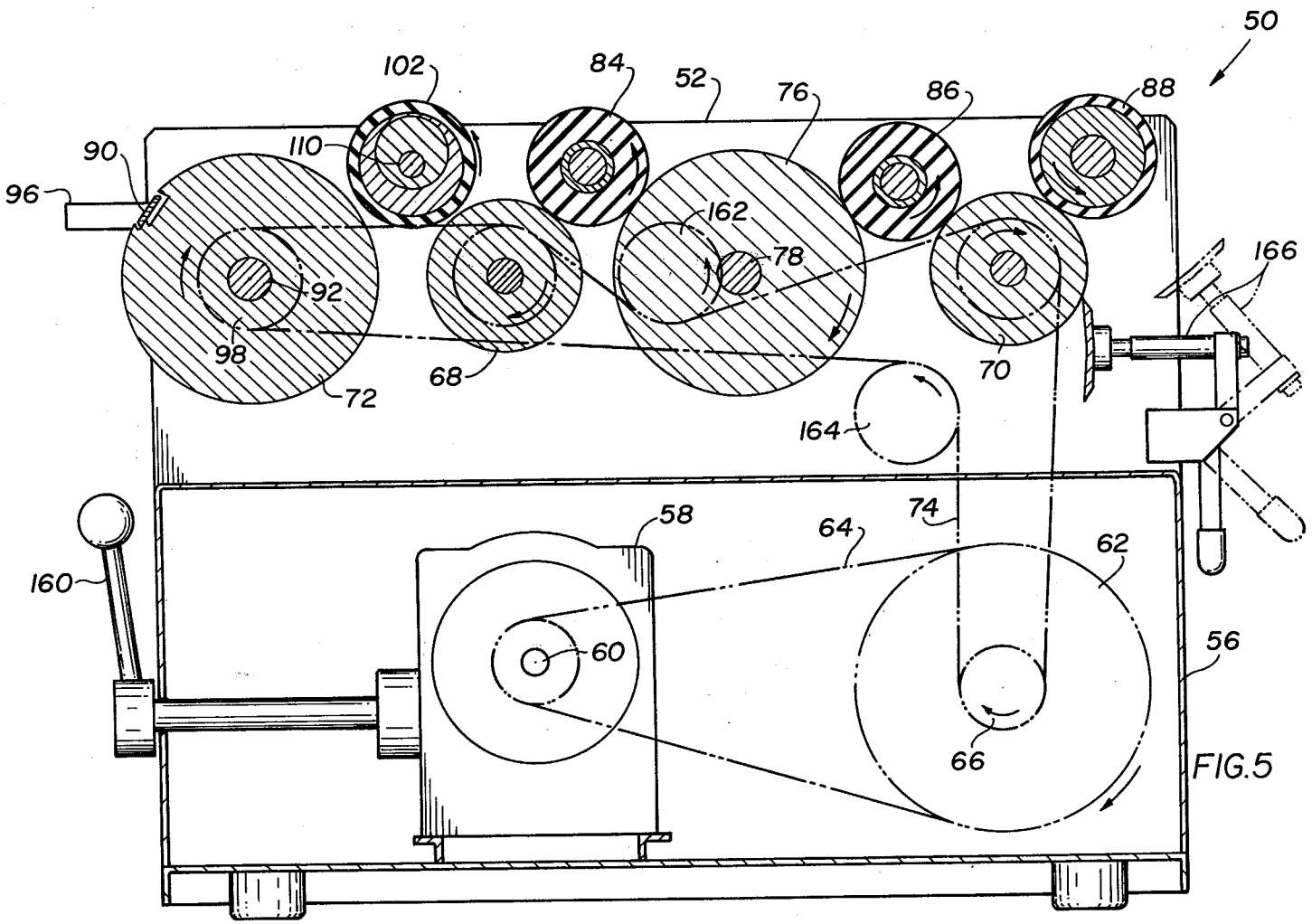
Figures 6, 7, 8, 9:
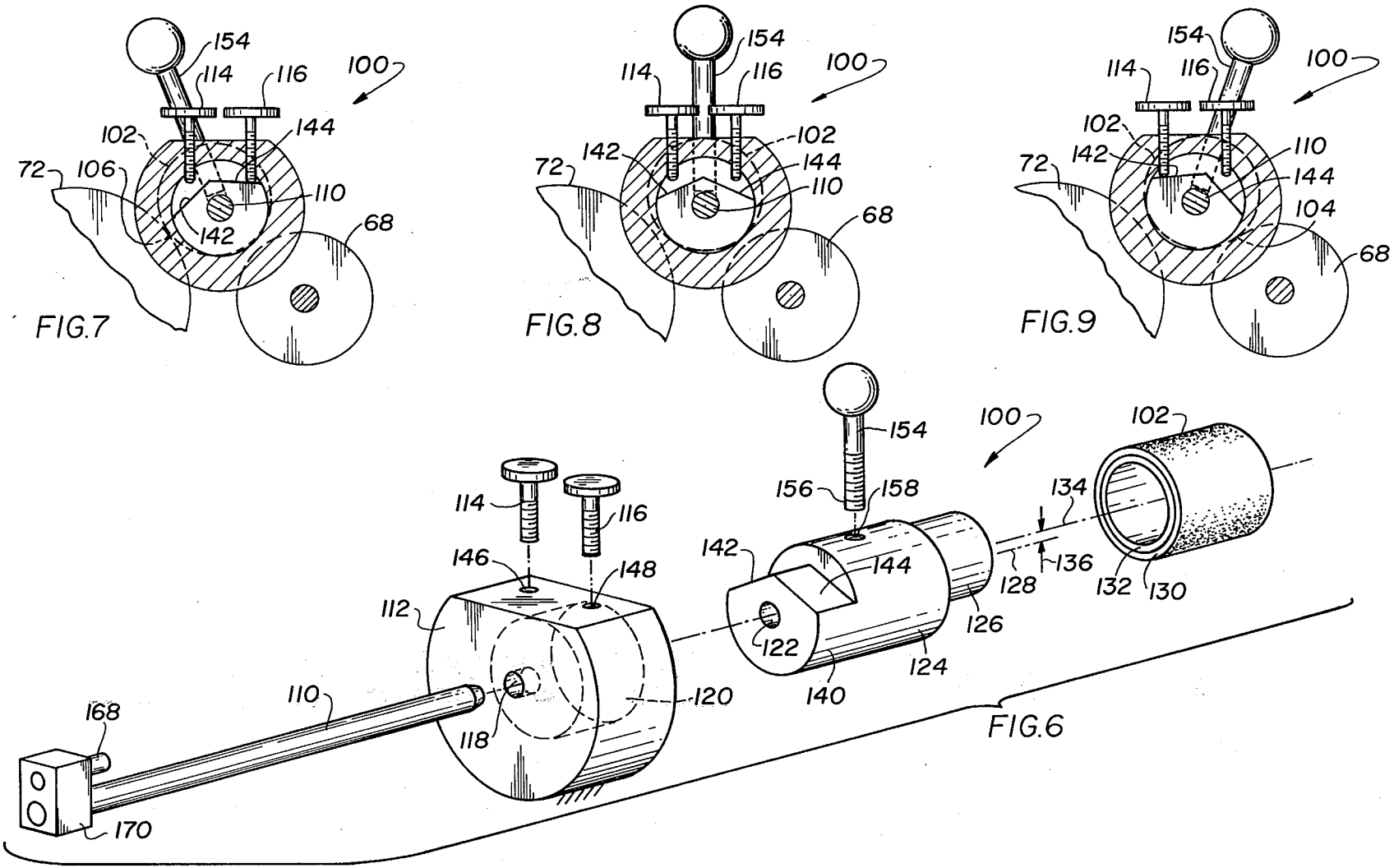

FIG. 5 is a side elevational view of the proofing press taken along line 5—5 of FIG. 4; and On the remaining separate drawing sheet are FIGS. 6–9 illustrating the specific structure of the within proofing press, and its mode of operation, which is involved in the production of a FIG. 2 proof sample. Specifically, FIG. 6 is an exploded perspective view of a pivotally traversable inking roller component of said proofing press, and FIGS. 7–9 illustrate the various positions of movement of said roller during its pivotal traverse in transferring an ink film onto a paper substrate incident to producing the proof sample of FIG. 2.

Good practice in preparing for a printing run requires, for a number of reasons which are well understood, the preparation of proof samples, such as the sample 10 of FIG. 2, in order to check out various aspects and parameters of the contemplated printing run. Thus, for example, a sample 10 is selected which utilizes as a substrate 12 a strip of the paper that will be used during the printing run, and the area 14 thereof is printed with the color, viscosity, etc. of an ink film 16 that will be utilized during the contemplated printing run, so that visual inspection and other testing of the resulting so-called proofing press sample 10 will give a helpful advance idea of the quality of printing that can be expected during the actual printing run. Specifically, assuming that it is significant that the color of the ink 16 precisely conform to a selected standard, after the production of the sample 10 the same might typically be placed in a spectrophotometer and reflectance curves obtained of the ink deposit 16 so that a precise comparison can be made with a color standard; or, if this level of accuracy is not required, at the very least the sample 10 might typically be very carefully studied visually, and even be shown to the customer for approval, before the printing run is commenced. Naturally, if the sample 10 indicates any defects in the color of the ink 16, or in any other aspect of the ink or, for that matter, in the ability of the paper substrate 12 to accept the ink, changes can be made to correct these defects prior to the printing run.

Figure 1:
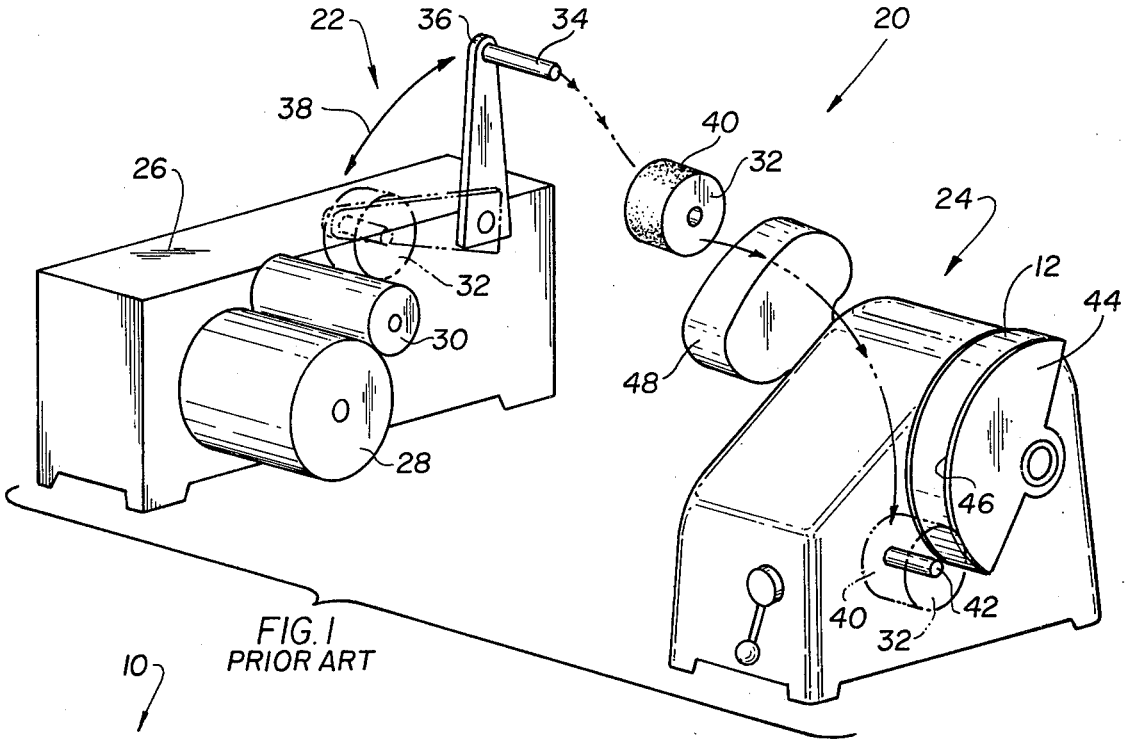
FIG. 1 PRIOR ART
FIG. 1 is a perspective view of what is typically used in the prior art to obtain a proof sample preparatory to a printing run.

While there are numerous embodiments of proofing presses available for the production of one or more proofing press samples 10 for various checking purposes, one said proofing press being illustrated in FIG. 1, the operation of these known proofing presses and their ability to accurately forecast the quality of printing of a contemplated printing run on commercial printing equipment is not entirely satisfactory. In this connection, it is known that the quality of printing is affected by the speed at which the paper substrate is moved relative to the printing roller of a commercial printing press or vice versa, and that it is also affected significantly by the printing pressure established between the printing roller and the paper substrate. Nevertheless, the aforesaid speed of printing and printing pressure are not duplicated in the production of the proof sample using the typical prior art proofing press of FIG. 1. This, of course, significantly detracts from the usefulness of the proofing press sample 10 as an accurate indicator of what can be expected during the contemplated printing run. The prior art FIG. 1 proofing press also characteristically is comprised of two separate units, one being used for the formation of the ink film to be tested, and the other for applying this film to a paper substrate strip 12 in the production of the sample 10. In contrast, and as will be described in detail subsequently, the improved proofing press hereof combines all of the functions and the operating requirements for production of a sample 10 in a single unit.

As background in assisting in recognizing the improvements of the within proofing press, more particularly illustrated in FIGS. 3–9, it is helpful to first understand how a typical prior art proofing press operates and thus reference should initially be made to FIG. 1. The FIG. 1 proofing press, generally designated 20, actually consists, as clearly illustrated in FIG. 1, of two separate units 22 and 24. Unit 22 is an inking press having a motor internally of a housing 26 which is operationally arranged to power in rotation roller 28 which, in turn, powers in rotation idler roller 30. An ink supply or deposit is placed on the cooperating rotating rollers 28 and 30 and is effectively spread into an even ink film which covers the surfaces of these rollers, particularly roller 30. An impression or inking roller 32 is adapted to be selectively mounted and journalled for rotation on a support shaft 34 of a pivoting arm 36. As may be readily appreaciated by the full line and phantom line illustrations of arm 36, the pivotal traverse 38 thereof is effective in bringing the inking roller 32 into printing contact with the roller 30, thus resulting in the transfer of the surface coat of ink from the roller 30 to the roller 32.

When an even coat of ink 40 has been applied to the surface of the inking roller 32, the roller is moved from the support shaft 34 of unit 22 and placed on a support shaft 42 of unit 24, thus advantageously locating the inking roller 32 in printing relation to a paper transport segment 44. The peripheral edge 46 of segment 44 is appropriately constructed to have mounted thereon a strip or length of paper substrate, such as strip 12, following which segment 44 is rotated so as to move the strip 12 into contact with the ink film 40 of the inking roller 32. Rotative movement of the segment 44 is typically achieved using a gravity drive, wherein the rotative power is obtained using a weight 48 which is released for gravity movement and is appropriately arranged during such movement to cause corresponding rotative movement of the segment 44.

Significant for present purposes, and as should readily be appreciated from the above description of the prior art proofing press 20, is that although it is capable of producing the required proofing press sample 10, the conditions of production thereof are not related to the contemplated speed and pressure of the printing run that the sample 10 is intended to monitor Not only is there this shortcoming in a typical prior art proofing press sample 10, but there is also an unnecessary amount of time and effort required in its production as evidenced, for example, by the need for the manual transfer of the inking roller 32 from the inking station 22 to the printing station 24.

Reference is now made to FIGS. 3–9 illustrating the within improved proofing press, generally designated 50, embodying many features which provide noteworthy improvements over the prior art proofing press 20, not the least of which is that the previously noted two inking and printing units 22 and 24 are effectively provided in a single compact unit 50 as illustrated. In this regard, the proofing press 50 includes two spaced apart support plates 52 and 54 between which there are mounted in spanning relation a number of rollers providing inking and printing functions necessary to produce the proofing press sample 10. Specifically, and as perhaps may be most readily understood by reference to FIGS. 4, 5 in addition to FIG. 3, disposed internally of a housing 56 adjacent the support plate 54 is a variable speed motor 58 with a laterally extending shaft 60. Spaced from the motor 58 within the housing 56 is a rotatably mounted roller 62 which, in accordance with the present invention, is a driving roller for the previously noted rollers that are supported between the support plates 52 and 54. Thus the drive of the roller 62 is imparted to it by the entrainment of a pulley belt 64 about the motor shaft 60 and roller 62. Affixed to the driving roller 62 is a power take off roller 66.

Figure 3:
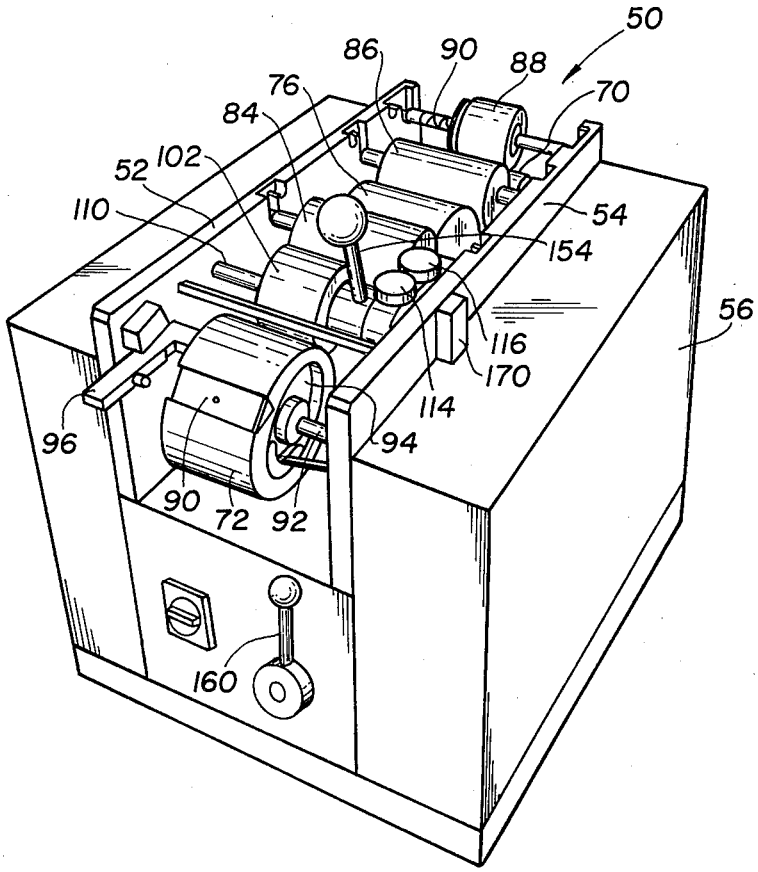
FIG. 3 is a perspective view of the proofing press hereof which is useful in obtaining the proof sample of FIG. 2, said proofing press being an improvement over the proofing press of FIG. 1 and other known proofing presses.

Still referring to FIG. 5 primarily, and also to FIGS. 3, 4, the significant rollers mounted in spanning relation between the support plates 52 and 54 include a front driven roller 68 (not shown in FIG. 3) and, spaced therefrom, a rear driven roller 70 (only partially visible in FIG. 3). The just noted driven rollers 68 and 70 essentially define the ink-film forming station of the proofing press 50, i.e. the portion thereof which provides the inking function of the prior art unit 22, all as will be explained subsequently.

The other significant roller supported in spanning relation between the support plates 52 and 54 is a sample substrate transport roller 72 (similar in function to the prior art segment 44) which is located just forward of and adjacent to the front driven roller 68. Entrained about the previously noted power take off roller 66 of the driving roller 62 and the just named rollers 68, 70 and 72 is a pulley belt 74. Thus, rollers 68, 70 and 72 are all rollers which are driven or powered in rotation by the rotative power of the variable speed motor 58, said power transmission being via the pulley belts 64 and 74. The significance of this will soon be apparent.

The previously noted roller 68 essentially performs the function performed by prior art roller 30 to the extent that it is the roller to which the coat of ink to be tested is evenly applied preparatory to transfer thereof to the paper substrate 12 in the production of a proofing press sample 10. Thus to achieve a smooth and even application of an ink film to the roller 68 cooperating idler rollers are provided. Specifically, centrally of the clearance space between the rollers 68 and 70 there is provided a large diameter idler roller 76 advantageously mounted for rotation, as best illustrated in FIG. 4, on a stationary shaft 78 machined with reversing-direction threads 80. As a consequence, and as is well understood, rotation of the idler roller 76 about the shaft 80 produces, in conjunction with rotative movement thereof, also reciprocating movements 82 back and forth along the longitudinal axis of the shaft 80. To produce this rotation in the roller 76 there are idler rollers 84 and 86 disposed in spanning relation respectively between the driven roller 68 and roller 76, and between roller 76 and the other driven roller 70. To further enhance the ink film spreading and forming function, the illustrated embodiment also includes a further idler roller 88 mounted rearwardly of the rear driven roller 70, roller 88 being further journalled for rotation on a stationary machined shaft 90 which results in movement of roller 88 in opposite directions transversely of the driven roller 70. To summarize up to this point, and thus to summarize primarily the description of the ink film forming components of the improved proofing press hereof, in response to the powering in rotation of the two driven rollers 68 and 70 there is of course cooperating rotation in the idler rollers 84, 76, 86 and 88 in contact with these driven rollers, all of which in a well understood manner has the effect of causing any ink which is deposited on any one of these rollers, as for example the centrally located large roller 76, to spread itself into an even and smooth surface coat on all of these rollers, including specifically the front driven roller 68.

Spaced from the front driven roller 68 is, of course, the previously noted substrate transport roller 72. This roller includes a peripherally located paper grip mechanism 90 which, in practice, effectively grips one end of the proof sample 10 so that the remaining length portion extends somewhat in partially wrapped relation about the peripheral surface of the roller 72. Supporting the roller 72 for rotative movement is a conventional shaft 92 connected between the support plates 52 and 54. Actually, in the illustrated embodiment, roller 72 is more in the form of a cylindrical ring and interposed between it and support shaft 92 is a manually operated conventional clutch 94 which may be any one of many commercially available models. Clutch 94 will be understood to be of the type which includes an external control member 96 which when operated, as by being depressed, causes a corresponding operation of the clutch to the extent that a drive connection is completed via the clutch 94 between the roller 72 and the shaft 92, which shaft 92, as illustrated in FIG. 5, will be understood to be powered in rotation as a result of the movement of pulley belt 74 driving in rotation a pulley 98 which is affixed to the shaft 92. However, the normal condition of clutch 94 is one in which the powering shaft 92 merely rotates in the bearing of the clutch 94 without causing any rotative movement in the ring-like roller 72. As a consequence, the proof sample 10 is mounted in the grip 90 and will not be urged through printing movement or passing relation to an ink-transferring surface until actuation of the clutch control member 96. When this actuation occurs, however, the substrate transport roller 72 will be urged through rotative movement at a speed which of course is related to the speed of operation of the variable speed motor 58 since the drive for roller 72 is derived from the motor 58, as previously explained.

From the description thus far provided it will of course be recognized that the transfer of the ink film of the roller 68 to the paper substrate sample 10 on the transport roller 72 requires a component effective to make contact initially with the roller 68 and subsequently with the roller 72. In accordance with the present invention this is achieved by a pivotally traversable impression or inking roller constructed and operating as shown in FIGS. 6–9 and generally designated 100 therein. This mechanism includes an ink-receiving roller surface 102 which, as shown in FIG. 9, in one position of the mechanism 100 is adapted to be in ink-receiving contact, as at 104, with the driven roller 68. From this position roller 100 is pivotally traversable in a counter-clockwise direction for establishing contact for the surface 102, as at 106, with the transport roller 72, as illustrated in FIG. 7. The neutral or intermediate position is illustrated in FIG. 8.

As will be explained, not only is the inking roller 100 pivotally traversable so that the ink film picked up by the surface 102 is readily transferred into printing contact relative to the paper substrate on the transport roller 72, but also the pressure established between the rollers providing the nips 104 and 106, respectively, is of a controlled and regulated nature. Thus, in accordance with the object of the proofing press 50 hereof, as already explained, the driven rollers 68 and 72 are readily powered in rotation at speeds related to the speed of rotation of the variable speed motor 58 and thus it is readily possible and, in fact, contemplated that a speed of rotation will be selected for each roller 68, 72 which corresponds to the contemplated speed of operation of the commercial printing equipment to be used for the contemplated printing run which is being monitored by the proofing sample 10 being produced by the proofing press 50; and now also by appropriate selection of the pressure for the nips 104 and 106, the contemplated printing pressure for the commercial run can also be simulated during production of the proofing sample 10. As a consequence, the ink film deposit 16 of the proof sample 10 represents a fairly accurate forecast of the printing quality that can be expected during the contemplated printing run.

Before explaining how impression nips 104 and 106 of varying extents can be obtained, it should be noted that the fact that the rollers 68 and 72 are driven rollers rather than idler rollers makes it possible to even regulate the pressure. In other words, if either of the rollers 68 and 72 were not driven positively in rotation by the rotative power of the variable speed motor 58 the mere pressing of the surface 102 against either of these rollers, even to a nominal extent, would have a braking effect on the rotation of these rollers and thus would certainly terminate their rotation. It is thus a significant contribution of the present invention to recognize that roller 68 of the inking station of the apparatus and roller 72 which is instrumental in carrying the paper substrate 10 through its printing movement must both be positively driven in rotation in relation to the inking roller 100 in order to be able to effectively regulate the pressure at which the roller 100 establishes its contact with each of these rollers.

As is perhaps best illustrated in FIG. 6, the inking roller 100 includes a centrally located shaft 110 which is mounted in spanning relation between the upper portion of the support plates 52 and 54 (see FIG. 3). Stationarily mounted on the inner surface of the upper portion of plate 54 is a housing 112 for a pair of stop members 114, 116 which define the opposite limits of the pivotal traversing movement of the inking roller 100, as will soon be explained. Shaft 110 is inserted through a central opening 118 of housing 112 and also through a counterbore 120 of the housing 112 which, being on the side not visible in FIG. 6 is illustrated in phantom perpective. Shaft 110 is also projected through a central throughbore 122 of a cylindrical member 124 having a cylindrical extension 126 thereon which is eccentrically disposed relative to the longitudinal axis 128 of the throughbore 122. The previously noted ink-receiving surface 102 is comprised of an elastomeric cylindrical body 130 which is fitted over a sleeve bearing 132 and the assembly 132, 130 is then journalled for rotation on the eccentric 126. In addition to a degree of rotational movement of surface 102 about the longitudinal axis 134 of the elastomeric cylinder 130, the assembly 130, 132 also has, as a degree of movement, a pivotal traverse to the extent of the offset 136 which exists between the longitudinal axis 128 of the eccentric 126 and the longitudinal axis 134 of the cylindrical body 130. It will of course be recognized that it is this degree of traversing movement which enables the surface 102 to establish one or the other of the previously noted pressure nips 104 and 106.

In accordance with the present invention, adjustable stops are provided to limit or establish the opposite end limits of the traversing movements which, in turn, establish the respective pressure nips 104 and 106 and, in this manner, enable corresponding regulation of the extent of the pressure existing in the pressure nips 104 and 106. That is, as has already been indicated, the ink-transferring surface 102 is elastomeric and thus this surface, when pressed against a solid metallic surface, will result in compression of its elastomeric construction material. Moreover, the pressure that will result will be a function of the extent to which compression of the elastomeric surface 102 is permitted. This, in turn, is a function of how far the pivotal traversing movement is permitted since a greater extent of movement will of course result in a greater compression of the elastomeric surface 102 and, in turn, will result in a greater prevailing pressure being produced by the contact of the surface 102 against the unyielding, solid or metallic surface. Not only is a range of pressure possible in each of the pressure nips 104, 106, but this variation in pressure is not measured or supervised by a pressure gauge or any other such special measuring device, but rather is provided by merely limiting the opposite terminal portions of the traversing movement of the surface 102 and calibrating this movement, all as will now be explained.

As is perhaps best illustrated in FIG. 6, at the end of member 104 remote from the eccentric 126 there is an axial extension 140 which, after machining, is provided with two angularly oriented stop surface 142 and 144. Extension 140 is seated in the counterbore 120 of housing 112 with the stop surfaces 142, 144 respectively aligned with two vertically oriented threaded bores 146 and 148 which open into the counterbore 120. Threadably disposed in the bores 146 and 148 are the threaded stops 114 and 116. Accordingly, the threaded position of each stop 114, 116 in turn determines the extent of rotative movement of extension 140 about the shaft 110 within the counterbore 120. Specifically, as illustrated in FIG. 7, threadable adjustment of stop 116 determines when the bottom stop surface thereof makes contact with the stop surface 144, thus limiting the extent of the pivotal traverse in the direction 150. In the opposite direction, as illustrated in FIG. 9, threaded adjustment of the stop 114 determines when contact is made with the opposite stop surface 142 thus limiting the pivotal traverse movement in the direction 152. It should be readily appreciated that allowing an extensive pivotal traverse in the direction 150 will permit the buildup of pressure in the pressure nip 106, and vice versa, and this is likewise the situation in the direction 152 in connection with the pressure nip 104.

Although not shown, it will be understood that associated with each threadable stop 114, 116 there is a scale or the like for calibrating the rotative positions of each with different prevailing pressures in the pressure nips 104 and 106.

Completing the construction of the inking roller 100 is a radially extending handle 154 which not only is provided for conveniently manipulating the surface 102 through pivotal traversing movements, as just described, but which assists in holding the surface 102 in its opposite positions of movement in which it respectively establishes the pressure nips 104, 106. To this end, a lower end of handle 154 is threaded, as at 156, and is threadably disposed in a threaded bore 158 which is machined in radial orientation in the member 124 so that it intersects with the throughbore 122 of the shaft 110. Assuming, therefore, that the pressure nip 106 is established, as illustrated in FIG. 7, threaded adjustment of the handle 154 moves the bottom end thereof into holding contact against the shaft 110, thus holding the surface 102 in its position of contact against the transport roller 72, but without interfering with rotative movement of the surface 102. To release surface 102 from the pressure nip 106, it is of course only necessary to unthread handle 154 from its contact against the shaft 110. As illustrated in FIG. 9, handle 154 is of course similarly useful in urging the surface 102 into pressure contact against the from driven roller 68 to establish the pressure nip 104, after which it is threaded into engagement against the shaft 110 to hold this position of movement without interfering with rotation of the surface 102.

Omitted from the description of the improved proofing press 50 hereof have been details of conventional features which are not necessary for an understanding of the invention. For example, for convenience in selecting the rotational speed of the variable speed motor 58 an external motor control level 160 is utilized. Also, as illustrated in FIG. 5, proper tension in the pulley belt 74 is facilitated by using take-up rollers 162 and 164. Finally, to assist in removal of the ink film from the rollers which define the inking station of the proofing press 50 use is effectively made of a scraping mechanism 166, the positions of movement of which are illustrated in full line and phantom perspective in FIG. 5.

Since, as described, shaft 110 is utilized as holding structure in conjunction with the handle 154 for maintaining the positions of traversing movement of the surface 102, it is of course necessary to hold the shaft 110 against rotation. This is achieved by use of a laterally extending pin 168 which is projected in a cooperating opening in the support plate 54. Also, to assist in maintenance or repair disassembly of the unit 50, and thus in the removal of shaft 110 from its supporting position in spanning relation between the plates 54 and 52, there is mounted on an end of the shaft 110 a block 170 which functions as a convenient grip facilitating withdrawing movement of the shaft 110.

From the foregoing description it should be readily appreciated that there has been described herein an improved proofing press 50 which combines in a single construction the inking station for the pivotally traversable inking roller 100 and a printing station for a paper substrate which is moved in printing relation relative to the inking roller 100. Since the rotative speed of the inking roller 68 and of the paper substrate transport roller 72 are derived from the variable speed motor 58, it is of course readily possible to achieve transfer of the ink film from roller 68 to the ink transfer surface 102 and from this surface to the paper substrate on the roller 72 at any selected speed, which of course would correspond to the speed to be used during the contemplated printing run. In practice, if the printing run will be conducted on a web press the speed at which the transfer might typically be made from the roller 68 to the paper transport roller 72 would be approximately 300 feet per minute, whereas if it is conducted on a letter press, it should be 105 feet per minute, and lastly, if it is to be conducted by an offset press, it should be approximately 200 feet per minute. Not only does the proofing press 50 hereof effectively simulate the printing speed, but it should also be readily apparent that depending upon the adjustments of the stops 114 and 116 that it is also readily possible to adjust the pressure in the pressure nips 104 and 106 so that the printing pressures during the contemplated printing run can also be effectively simulated.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. For use preparatory to a printing run to be conducted at a selected speed and printing pressure, a proofing press for producing a sample printed at said speed and pressure for checking purposes comprising a variable speed drive operatively arranged to power in rotation at least one driving roller, drive means connected from said driving roller to transmit the rotative movement thereof to a cooperating pair of front and rear driven rollers spaced from each other so as to define an ink film forming station therebetween, plural idler ink film forming rollers operatively arranged to be driven in rotation by said front and rear driven rollers so as to spread an ink supply into a film on the surfaces of each idler roller and on said pair of driven rollers, a substrate sample transport roller spaced from said front driven roller so as to define a sample inking station therebetween, drive means connected from said driving roller to transmit the rotative movement thereof also to said substrate sample transport roller, and an inking roller at said inking station mounted to be pivotally traversable between positions of established pressure contact initially with said front driven roller having said ink film over the surface threof and subsequently with said substrate sample being urged through printing movement relative to said inking roller by said transport roller, whereby said sample is printed at a speed selected for said transport roller and at a pressure corresponding to said established pressure contact therewith.

2. A proofing press as claimed in claim 1 wherein said pivotally traversable mounting for said inking roller comprises a shaft arranged in parallel relation to the rotation axis of said transport roller, a cylindrical support member disposed in eccentric relation on said shaft, and said inking roller being rotatably disposed about said cylindrical support member, whereby there is a degree of pivotal traversing movement in addition to rotation of said inking roller to the extent of offset between the longitudinal axis of said shaft and the center line of said eccentrically disposed support member.

3. A proofing press as claimed in claim 2 wherein the construction material of said pivotally traversable inking roller is elastomeric, and there are stop means operatively arranged to define the limits of said pivotal traversing movement thereof, whereby the extent of the pressure contact established with said inking roller is a function of the extent of compression of said elastomeric material that is permitted by a cooperating stop means.

4. A proofing press as claimed in claim 3 including a handle threadably mounted in a radial orientation on said cylindrical support member and adapted to be threadably engaged into holding contact against said shaft disposed centrally of said cylindrical support member, whereby said handle is useful in urging said inking roller through said pivotal traversing movements and upon said threaded engagement against said shaft in holding said inking roller in a selected position of movement.

5. For use preparatory to a printing run to be conducted at a selected speed and printing pressure, a proofing press for producing a sample printed at said speed and pressure for checking purposes comprising a variable speed motor operatively arranged to power in rotation at least one driving roller, a cooperating pair of front and rear driven rollers spaced from each other so as to define an ink film forming station therebetween, plural idler ink film forming rollers operatively arranged to be driven in rotation by said front and rear driven rollers so as to spread an ink supply into a film on the surfaces of each idler roller and on said pair of driven rollers, a substrate sample transport roller spaced from said from driven roller so as to define a substrate sample inking station therebetween, a pulley connected from said driving roller to transmit the rotative movement thereof to said inking station driven rollers for producing said ink film at a selected speed related to said rotative speed of said driving roller and to said substrate sample transport roller for causing printing on said substrate sample also at a selected speed related to said rotative speed of said driving roller, and an inking roller at said inking station mounted to be pivotally traversable between positions of established pressure contact initially with said front driven roller having said ink film over the surface thereof and subsequently with said substrate sample being urged through printing movement relative to said inking roller by said transport roller, whereby said substrate sample is printed at a selected pressure corresponding to said established pressure contact of said inking roller against said transport roller.

6. A proofing press as claimed in claim 5 wherein said pivotally traversable mounting for said inking roller comprises a shaft arranged in parallel relation to the rotation axis of said transport roller, a cylindrical support disposed in eccentric relation on said shaft, and said inking roller being rotatably disposed about said cylindrical support member, whereby there is a degree of pivotal traversing movement in addition to rotation of said inking roller to the extent of offset between the longitudinal axis of said shaft and the center line of said eccentrically disposed support member.

7. A proofing press as claimed in claim 6 wherein the construction material of said pivotally traversable inking roller is elastomeric, and there are stop means operatively arranged to define the opposite limits of said pivotal traversing movement thereof, whereby the extent of the pressure contact established with said inking roller is a function of the extent of compression of said elastomeric material that is permitted by a cooperating stop means.

8. A proofing press as claimed in claim 7 including a handle threadably mounted in a radial orientation on said cylindrical support member and adapted to be threadably engaged into holding contact against said shaft disposed centrally of said cylindrical support member, whereby said handle is useful in urging said inking roller through said pivotal traversing movements and upon said threaded engagement against said shaft in holding said inking roller in a selected position of movement.

* * * * *

UNITED STATES PATENT OFFICE

CERTIFICATE OF CORRECTION

Patent No. 4,015,524 Dated April 5, 1977

Inventor(s) Lawrence Herbert

It is certified that error appears in the above-identified patent and that said Letters Patent are hereby corrected as shown below:

Claim 5, line 14, "spaced from said from driven roller" should read -- spaced from said front driven roller --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*